US005653632A

United States Patent [19]

Ogawa et al.

[11] Patent Number: 5,653,632

[45] Date of Patent: Aug. 5, 1997

[54] PHOTOSENSITIVE DRIVING DEVICE

[76] Inventors: Taro Ogawa, 3-52, Kojima Ajinokami 1-chome; Tomohiro Gohara, 134-38 Chayamachi, both of Kurashiki-city, Okayama Prefecture 711, Japan

[21] Appl. No.: 537,660

[22] PCT Filed: Feb. 7, 1995

[86] PCT No.: PCT/JP95/00162

§ 371 Date: Oct. 5, 1995

§ 102(e) Date: Oct. 5, 1995

[87] PCT Pub. No.: WO95/21313

PCT Pub. Date: Aug. 10, 1995

[30] Foreign Application Priority Data

Feb. 7, 1994 [JP] Japan ..... 6-33259

[51] Int. Cl.[6] ..... F24F 11/00

[52] U.S. Cl. ..... 454/343; 454/239; 454/347; 454/351

[58] Field of Search ..... 454/239, 253, 454/343, 347, 350, 351, 352

[56] References Cited

U.S. PATENT DOCUMENTS

| | | | |
|---|---|---|---|
| 1,792,514 | 2/1931 | Spear | 454/351 |
| 4,375,183 | 3/1983 | Lynch | 454/292 |
| 4,898,086 | 2/1990 | Norris | 454/340 X |

FOREIGN PATENT DOCUMENTS

| | | | |
|---|---|---|---|
| 57-65528 | 4/1982 | Japan | 454/347 |
| 63-122590 | 8/1988 | Japan . | |
| 63-272881 | 11/1988 | Japan . | |
| 2-20785 | 1/1990 | Japan . | |
| 2-91895 | 7/1990 | Japan . | |
| 2 218 800 | 11/1989 | United Kingdom . | |

*Primary Examiner*—Harold Joyce

*Attorney, Agent, or Firm*—Renner, Kenner, Greive, Bobak, Taylor & Weber

[57] ABSTRACT

A driving device which is automatically activated by detecting solar light and an automatic ventilation system utilizing the aforementioned driving device. An electric motor (21) is connected to relay switch (22), which is connected to limit switch (23) and light sensor switch (24). The limit switch (23) is connected between the relay switch (22) and the power supply and a manual main switch (25) between the light sensor switch (24) and the power supply. Normally when the main switch (25) is "on" and solar light exceeds the threshold, the light sensor detects it and the contact of the switch (24) changes to be activated. Electricity is then supplied to the relay switch (22) and the contact of the relay switch (22) also change to be activated. The electric motor is interlinked with a vent cover via the power transmission and the vent cover gradually begins to open. A specific time after the electric motor (21) is activated and the limit switch (23) comes in contact with the power transmission, then the limit switch's (23) contact changes to turn itself off. Thus the electric motor stops and the vent cover interlocked with the electric motor can stay open without operations of the manual switch. The main switch (25) normally stays in the "on" state, however, it can serve as a safety switch to forcibly shut down the system in the event of long-term shut down and maintenance.

21 Claims, 15 Drawing Sheets

PHOTOSENSITIVE DRIVING DEVICE

TECHNICAL FIELD

This invention is a driving device that responds to solar light, specifically a driving device for automatic ventilation, automatic shading or automatic light intake.

BACKGROUND ART

As a conventional ventilation system, the vent (2) of FIG. 1 is well known. This vent (2) is aimed to ventilate the attic, under the floor, or a basement of house 1. It is a fixed type vent with a louver cover as illustrated in FIG. 1(A). Under another conventional system, a vent (no illustration) which can be opened and shut manually or by an electric motor is well known. This is mainly used to ventilate a factory or a warehouse.

The conventional fixed-type vent does not have enough opening space due to aesthetics and space constraints of layouts. In addition, since it is continuously open, it cannot ventilate sufficiently and it takes in moisture during the night. This results in mold as well as poor insulation in summer and winter.

Another conventional open/shut vent has better ventilation than that of the fixed type. However, being manually operated, it is difficult to generate the optimum environment in response to climatic changes which occur indoors and outdoors. Moreover, if closing is neglected, it is inevitable that inventory in the warehouse would be seriously damaged.

DISCLOSURE OF THE INVENTION

Therefore, one purpose of this invention is to provide a simple, economical and safe driving device which can be automatically operated by detecting solar light.

The second purpose is to provide an automatic ventilation system utilizing the aforementioned driving device.

The third purpose is to provide an automatic ventilation system constructed with a combination of the aforementioned driving device and a ventilation fan.

And the other purpose is to provide an automatic ventilation system which consists of more than one aforementioned driving device to be operated simultaneously.

To achieve the above mentioned purposes, the light responsive driving device which resulted from this invention consists of an electric motor, a power supply, a relay switch connected to the electric motor, a limit switch connected between the aforementioned relay switch and the aforementioned power supply and a light sensor switch which is connected between the aforementioned relay switch and the previously mentioned power supply and detects the intensity of solar light. The characteristic of the device is that when the intensity of solar light exceeds the threshold, the above mentioned light sensor switch turns on, which automatically turns off the above mentioned relay switch. Then the above mentioned electric motor is activated. After a specific time the aforementioned limit switch turns off to automatically keep the electric motor off. It is feasible to install a manual main switch between the light sensor switch and the electric power supply. This is highly safe and efficient because when the main switch is turned off, the electric driving device is forcibly shut off regardless of the intensity of solar light. The light sensor switch can be set to a desirable threshold depending on seasons and sunshine conditions. Normally the light sensor switches, the limit switches and the relay switches are 1-circuit 2-contact type. However, the relay switches can be 2-circuit 2-contact type. In this case the electric motor's rotational direction reverses before/after turning on. A ventilation fan can be connected parallel to the electric motor or more than one unit consisting of an electric motor, a relay switch and a limit switch can be connected in parallel to one another. Furthermore if the light sensor switches are connected in parallel to one another, an 0R circuit can be formed.

The power transmission generated by this invention is to convert rotational movement of the electric motor to reciprocal linear movement. It is made up of a rotation part fixed to the axis of the electric motor, a link connected to the other end of the rotation part in a way to allow rotation, a connecting part which has a horizontal groove in the vicinity of the link and is connected to the other end of the link in a way to allow rotation, and an arm which is linked to the connecting part in a way to allow rotation and is connected to rectangular-shaped plates at one end in a way to allow rotation. The above mentioned link does not always have to be an integral part of the unit. In this case, the rotation part and the connecting part are directly connected in a way to allow rotation. This connection is applied to a driving device consisting of a 2-circuit 2-contact relay switch. The connecting part can be a single piece or more than one continuously aligned plural number of pieces.

The automatic ventilation system of this invention which is automatically activated by a specific intensity of solar light consists of a combination of the above mentioned driving device and the above mentioned power transmission.

BEST MODE FOR CARRYING OUT THE INVENTION

Figure 1A:
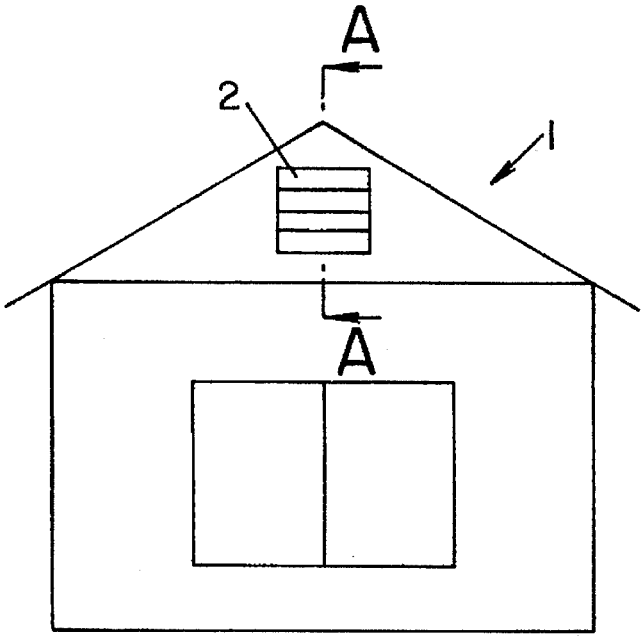
FIG. 1(A) (PRIOR ART)
FIG. 1(A)is a schematic illustrating a conventional fixed type vent.
Figure 1B:
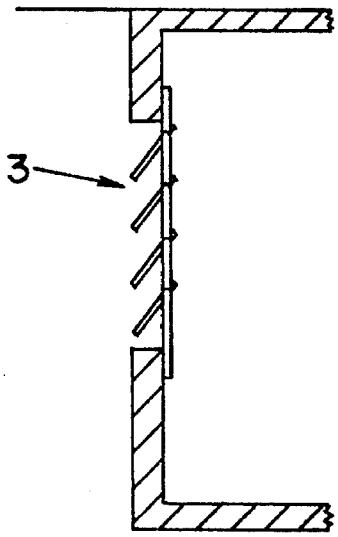
FIG. 1(B) (PRIOR ART)
FIG. 1(B) is a cross section A—A of the vent.
Figure 2:
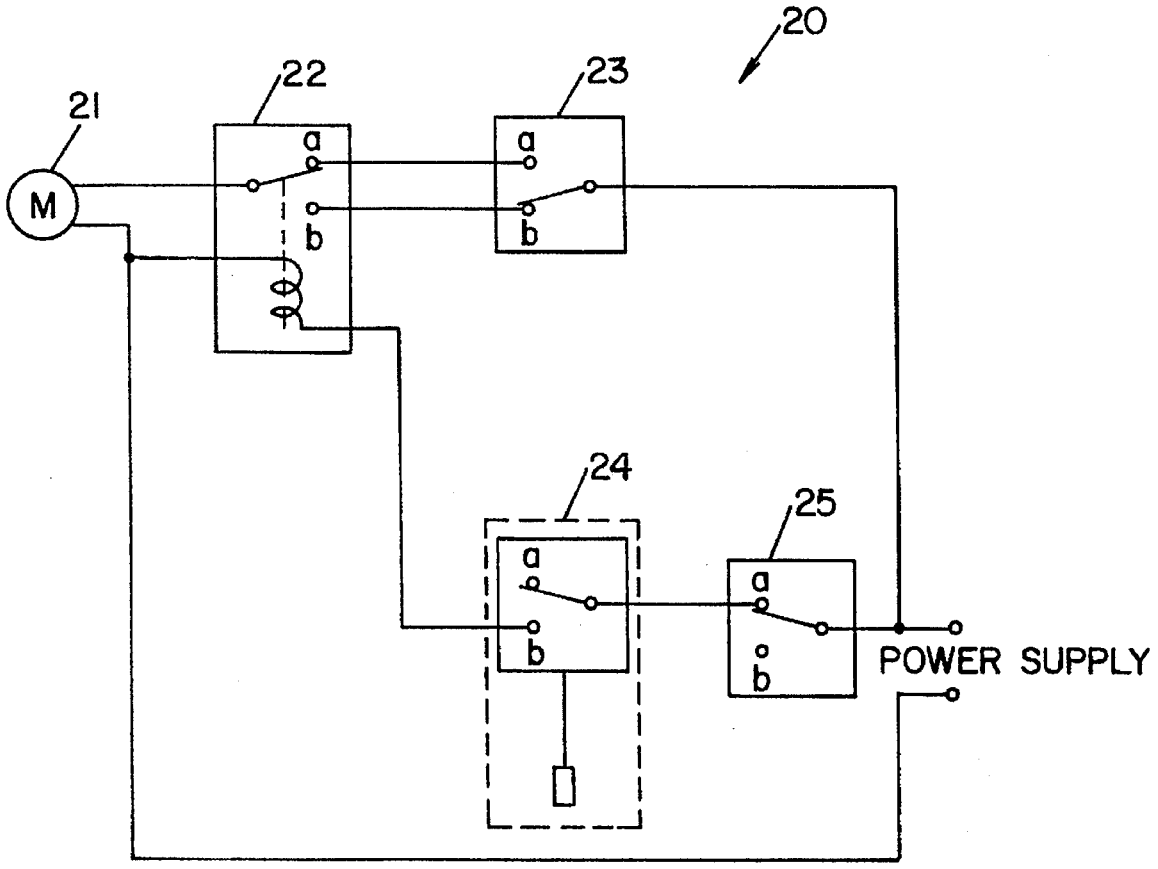
FIG. 2 is the basic circuitry of the desirable application of the light responsive driving device of this invention.
Figure 9:
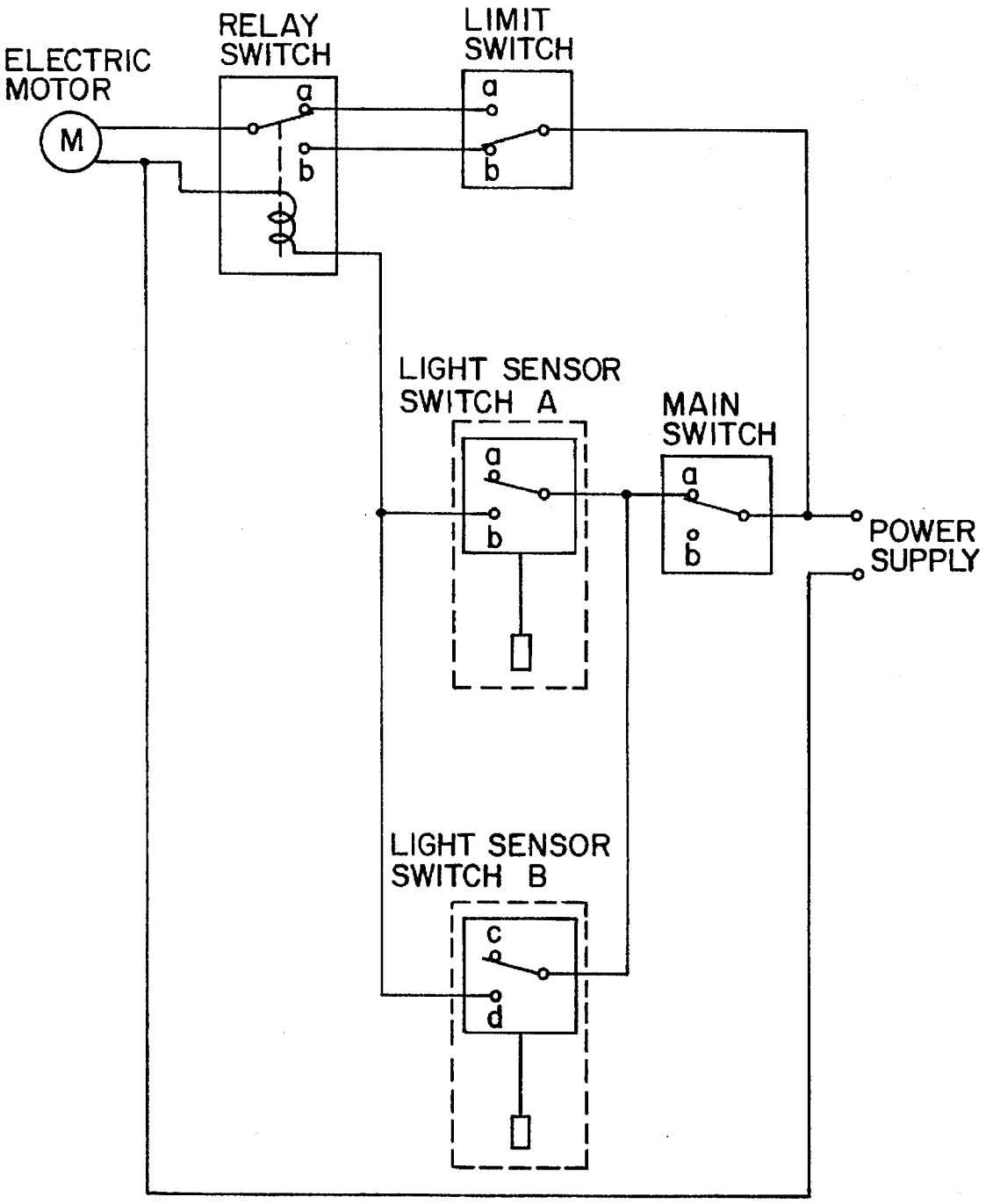
FIG. 9 is an OR circuit, a modified basic circuitry of the desirable example of the light responsive driving device by this invention using two light sensor switches.
Figure 10:
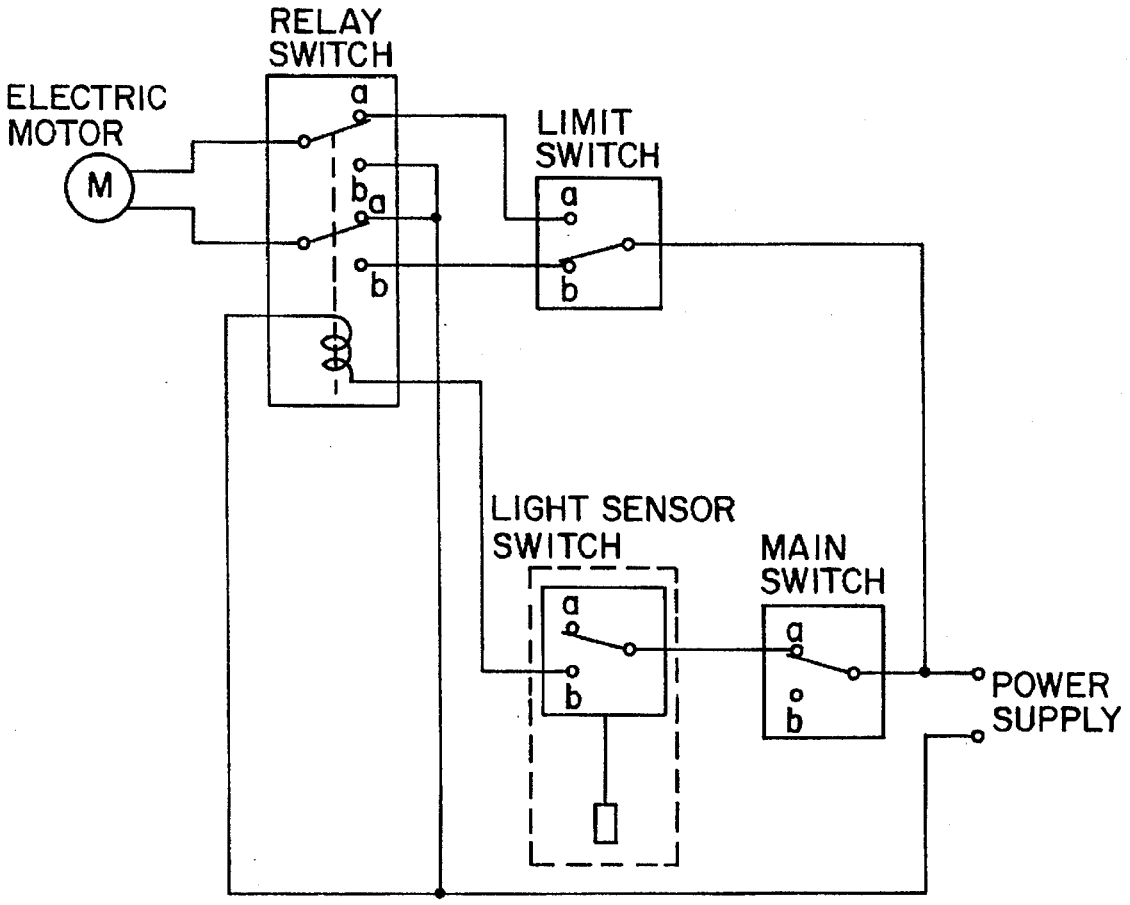
FIG. 10 is a modified direct current type circuit, replacing a relay switch with a 2-circuit 2-contact type in the basic circuitry for the desirable application of the light responsive driving device of this invention.
Figure 11:
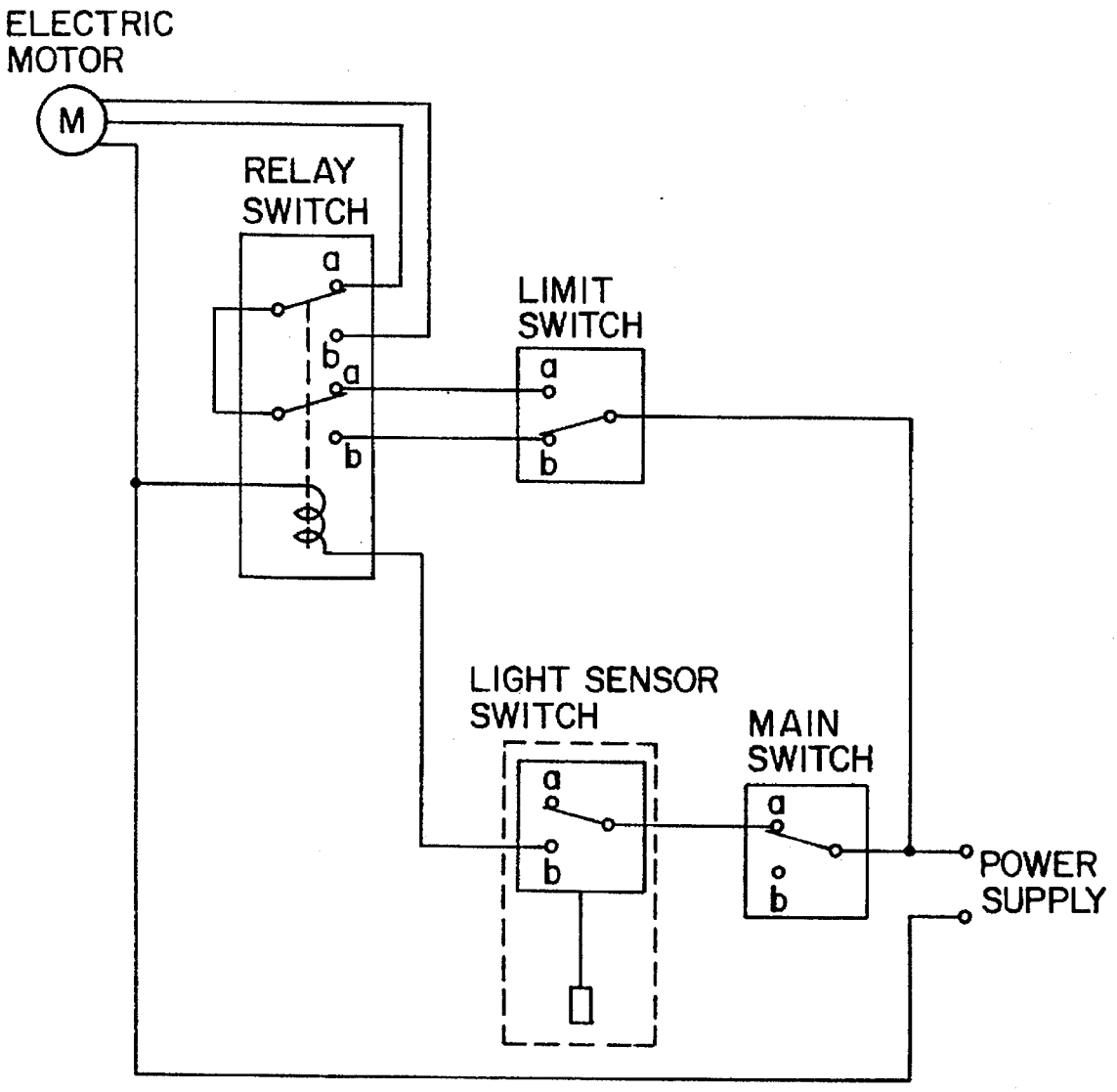
FIG. 11 is a modified alternating current type circuit, replacing a relay switch with a 2-circuit 2-contact type in the basic circuitry for the desirable application of the light responsive driving device of this invention.

FIG. 2 illustrates the basic circuitry of this invention's light responsive driving device, generally indicated by the numeral (20). This is the desirable application. The Circuit consists of the electric motor (21), the relay switch (22) to control the electric motor (21), the limit switch (23), the light sensor switch (24), the main switch (25) and the power supply. The electric motor (21) is connected to the 1-circuit 2-contact type relay switch (22), which is connected to the 1-circuit 2-contact type limit switch (23) and the 1-circuit 1-contact type light sensor switch (24). The limit switch (23) is connected between the relay switch (22) and the power supply and the manual main switch (25) is connected between the light sensor switch (24) and the power supply. Direct current power supply or alternating current power supply is used. The relay switch (22) can be 2-circuit 2-contact type as illustrated in FIGS. 10 through 15. FIG. 9 shows an option using parallel alignment of more than one light sensor switch. In this case an OR circuit is formed. Such light sensor switch should be used to select appropriate thresholds depending upon seasons and sunshine conditions.

The next explanation pertains to circuit movement. The threshold of the light sensor switch (24) should be set at around 35,000 lux under normal sun light. The threshold can be changed, for example, to around 20,000 lux in winter or for a season with weak sunshine. When the main switch (25) stays on and the sun light exceeds 35,000 lux, the light sensor detects it and moves the contact point of the switch (24) from "a" to "b" to activate it. Next, power is supplied to the relay switch (22) and the contact point of the relay switch 22 moves to "b" from "a" to be activated. When the contact point of the limit switch (23) is at "b", the current flows to the electric motor (21) to be activated. After the electric motor runs for the specific time, the contact point of the limit switch (23) changes from "b" to "a ", then shuts itself off. With this, an object connected to the electric motor is able to remain in the constant state automatically without operation of a manual switch. The main switch (25) normally remains "on", but in the event of a long term shut down or maintenance, it can be used as a safety switch to halt the system.

Figure 4A:
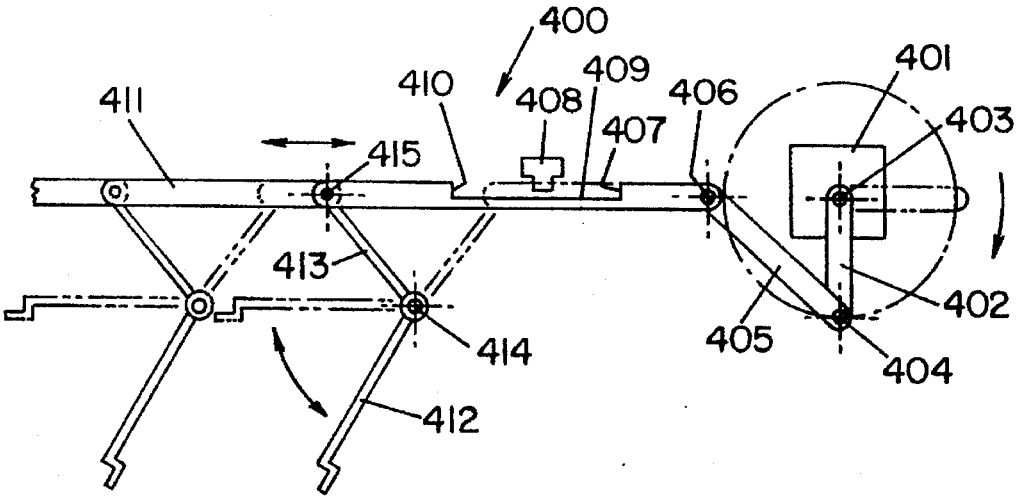
FIG. 4(A) is a sectional sketch of the power transmission of the desirable application of this invention.
Figure 4B:
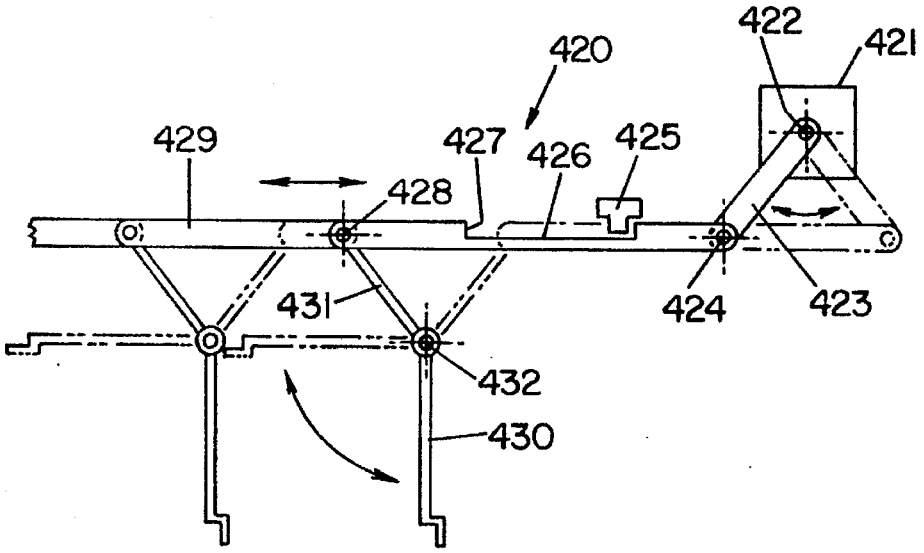
FIG. 4(B) is a sectional sketch of the power transmission used in a different application of this invention.
Figure 4C:
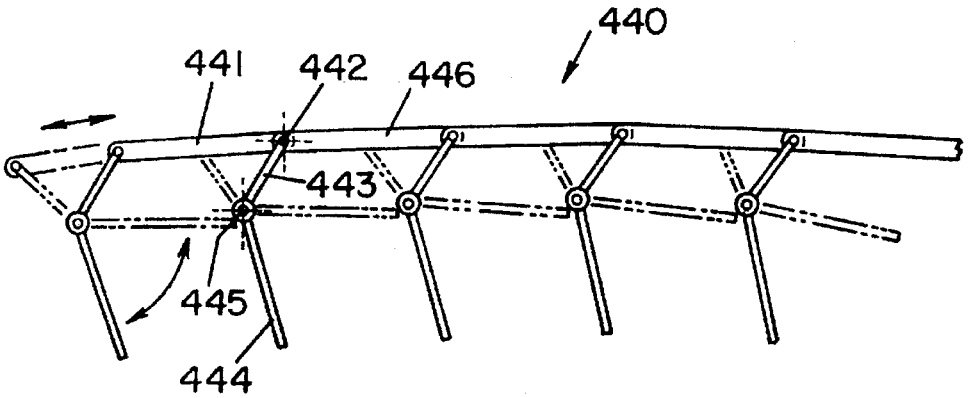
FIG. 4(C) is a sectional sketch of the connecting part of the power transmission used in a different application.

FIG. 4 is a sectional sketch of the power transmission which is a part of the automatic ventilation system of this invention. FIG. 4(A) shows the power transmission, generally indicated by the numeral (400), using a 1-circuit 2-contact type relay switch (Refer to the relay switch (22) of FIG. 2.), which is a part of the driving device of this invention. As per the circuitry in FIG. 2, the electric motor (401) only rotates in one direction. Namely the power transmission (400) is one-directional. The power transmission consists of the electric motor (401), the rotational part (402), the link (405) and the connecting part (411). The rotational part (402) is connected at one end to the motor axis (403). The link (405) which is connected to the rotational part (402) at an axis (404) in a way to allow rotation is to convert rotational movement of the motor (401) to reciprocating linear movement. A number of units consisting of the arm (413) which rotates around the axis (414) and the fan cover (412) which are connected to the link (405) and the axis (406) at one end in a way to allow rotation are linked at the same interval to the axis (415) in a way to allow rotation. The connecting part (411) has a shallow groove (409) which runs horizontally in the vicinity of the axis (406). By coming into contact of either side wall (407) and (410) of groove (409), the limit switch (408) switches on/off.

At the point when solar light intensity exceeds the threshold, the light sensor switch turns on, the relay switch contact then changes from "a" to "b", and the electric motor (401) is activated. At this time the limit switch contact is at the "b" point, but in the case of FIG. 4(A) it relates to the situation that the limit switch (408) comes into contact with the side wall (410). At this time the rotation part (402) is located horizontally to the right side (3 o'clock direction) and is aligned with the link (405) and the connecting part (411). Angles of the arm (413) and the cover (412) are adjusted in such a way that the fan cover (412) becomes parallel to the connecting part, which is the cover's closed position. As the motor rotates, the rotation part (402) draws a circle clockwise and the link (405) which is connected in a way to allow rotation converts rotational movement to the left direction linear movement. The connecting part (411) moves leftward and at the same time the fan cover (412) begins to open. Next, when the rotation part returns to the horizontal position (shown in FIG. 4(A)) and the limit switch (408) comes into contact with the right side wall (407), then the limit switch contact changes from "b" to "a". The current stops running to the electric motor and the fan cover (412) halts, being vertical to the connecting part (411), which is the wide open state. Furthermore, when solar light falls below the threshold, the light sensor switch turns off and the relay switch terminal changes from "b" to "a". At this time current resumes running to the motor, the electrical motor is activated and the rotation part (402) also begins to rotate, in a circular motion. Simultaneously the connecting part (411), moves rightward and fan cover (412) connected in a way to allow rotation, begins to close. When the rotation part (402) returns to its original horizontal position, the limit switch (408)/ comes into contact with the left side wall (410) and the limit switch contact changes from "a" to "b". At this point, the current stops running to the electric motor and the fan cover (412) stops, being horizontal to the connecting part (411), which is the closed position.

The above explains one cycle of this automatic ventilation system. By turning off the manual main switch (25) the entire system can be shut off. First, in the condition that the fan cover (412) is stopped and closed (namely, the relay switch's (22) contact is at "a" and that of the limit switch (23) is at "b"), by changing the contact of the main switch (25) from "a" to "b", the current does not flow into the coil of the relay switch (22) and the relay switch contact becomes fixed in the "a" state. As a result, the system remains completely "off" with the fan cover (412) stopped and closed, against any weather changes. Next, in the condition that the fan cover (412) is wide open (namely, the relay switch's (22) contact is at "b" and the limit switch's (23)

contact is at "a"), by changing the main switch's (25) from "a" to "b" manually, the current stops running into the coil of the relay switch (22) and the relay switch contact changes from "b" to "a". At this point, the electric motor is activated and the power is transmitted through the above mentioned power transmission to close the fan cover (412). When the fan cover (412) is completely closed and stopped, as explained earlier, the connecting part switches the limit switch contact from "a" to "b", the electricity ceases to run to the electric motor (21) and the system shuts down. As a result, the system remains totally "off" with the fan cover (412) stopped and closed against any weather changes. Therefore by turning off the manual main switch (25), the system can be brought to a complete stop with the fan cover stopped and closed against any weather changes.

FIG, 4(B) shows a power transmission, generally indicated by the numeral (420) using a 2-circuit 2-contact type relay switch (Refer to relay switches in the FIGS, 10–15.) which is part of the driving device of this invention. In these circuits the relay switch reverses the magnet field direction of either a rotator or a stator of the electric motor before/after changing the limit switch. As a result, the electric motor's rotation can be reversed. The power transmission (420) is a two directional rotating power transmission. It is to be noted that the power transmission (420) does not use a part equivalent to link (405). The rotational part (423) is directly joined to the connecting part (429) at axis (424) in a way to allow rotation. The rotation part (423) first converts the power of the electric motor (421) into a pendulum movement. When the connecting part (429) is connected to the rotating part (423) by the axis (424) in a way to allow rotation, it changes the pendulum movement to linear reciprocal movement. The connecting part (429) moves horizontally to right and left and has a groove (426), limit switch (425), and side wall (427) operating in the manner of groove (409), limit switch (408), and side wall (410) of power transmission (400).

One cycle movement of the power transmission (420) is t same as the aforementioned power transmission (400). However, the difference between them is that the rotation part (402) of the power transmission (400) circles once along the circumference per cycle, while the rotation part (423) of the power transmission (420) moves approximately 120 degrees along the reciprocating pendulum movement per cycle.

The optimal construction of the connecting part (411) is a solid metal plate, such as aluminum, or resin plate. Nevertheless, it can be of the construction as shown in FIG. 4(*c*). A number of units comprised of the arm (443) which is rotational around the axis (455) and the louver style fan cover (444) are joined continuously along the length of the short plate (441) by the axis (422) in a way to allow rotation. The connecting part, generally indicated by the numeral (440) can be used for a curved surface vent.

Figure 3:
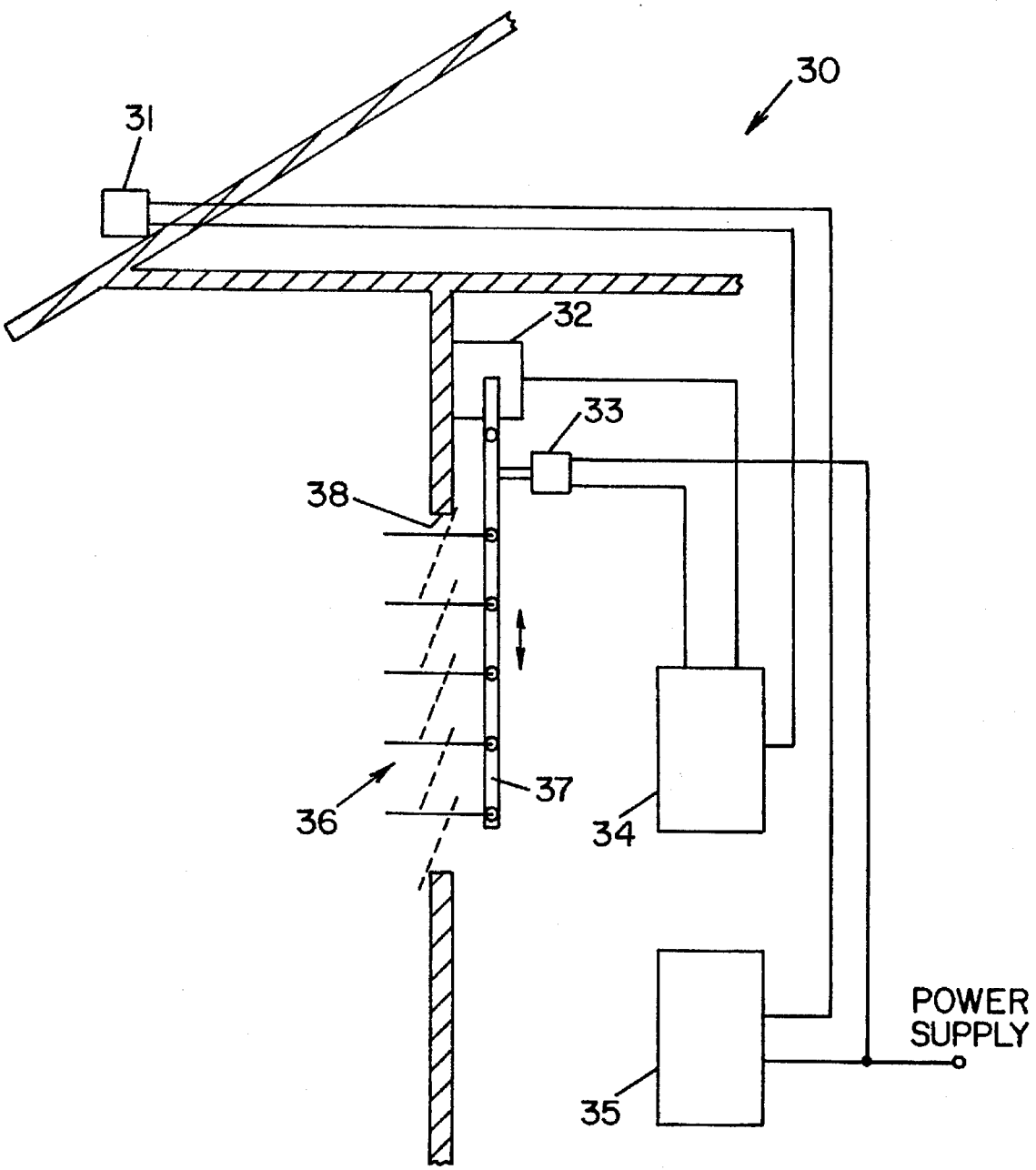
FIG. 3 is a sketch of the desirable application of the automatic ventilation system by this invention.

FIG, 3 represents a desirable application of the automatic ventilation system of this invention, which is a combination of a light responsive driving device using FIG. 2's basic circuitry and the power transmission in FIG. 4(A). The automatic ventilation system, generally indicated by the numeral (30) of FIG. 3 of this invention consists of the light sensor switch (31), the electric motor (32), the limit switch (33), the relay switch (34), the main switch (35), the power transmission (37), the fan cover (36) and the power supply. The electric motor (32) is connected to the relay switch (34), which is connected to the limit switch (33) and the light sensor switch (31) which is located on the roof. The limit switch (33) is connected between the relay switch (34) and the power supply in order to control the relay switch (34) by detecting the amount of movement of the power transmission (37). The manual main switch (35) is connected between the light sensor switch (31) and the power supply. The vent cover (36) is joined to the power transmission (37) in a way to allow rotation so that it opens and closes according to the up-and-down movement of the power transmission (37). The electric motor (32) is installed on the inner wall of the vent (38). The power transmission (37) is installed parallel to the surface of the vent (38) in a vertical direction to allow it to move up and down which corresponds to the electric motor 32's movement. The vent cover (36) is normally made up of 4 to 8 pieces of rectangular shaped metal or resin plates. It should be of sufficient length and width to cover up the vent when closed.

Figure 5:
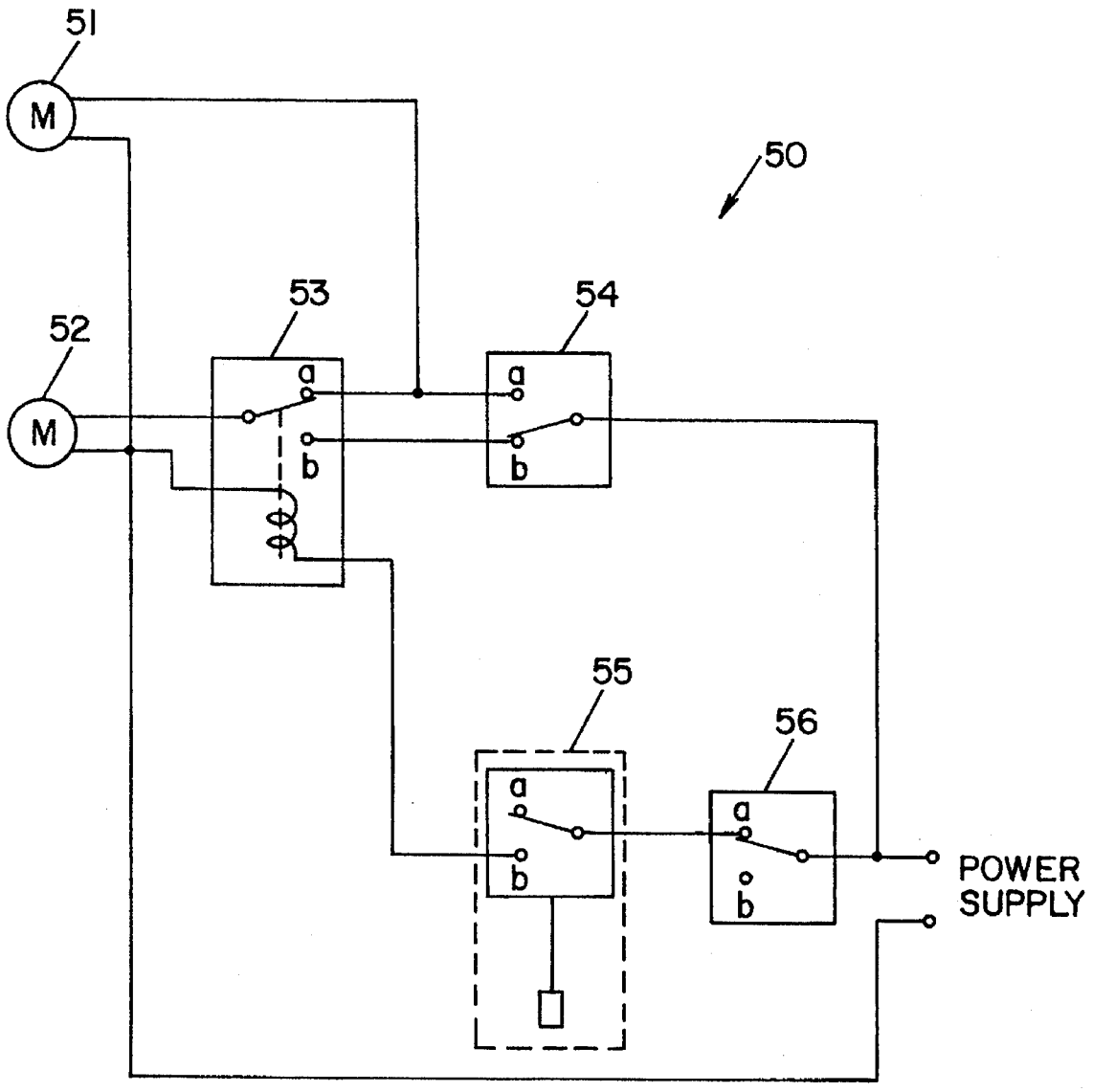
FIG. 5 is the basic circuitry of the second application of the light responsive driving device of this invention.

FIG. 5 represents the basic circuitry of the second application of the light responsive driving device by this invention.

The difference from the basic circuitry of FIG. 2 which reflects a desirable application of this invention is that the electric motor (52) and the ventilation fan (51) are connected in parallel. One end of the ventilation fan (51) is connected to one end of the electric motor (52) and the other end to the terminal "a" of the limit switch (54). When solar light exceeds the threshold of 35,000 lux, the contact of the light sensor switch (55) changes from "a" to "b" to be activated. Next the contact of the relay switch changes from "a" to "b" to activate the electric motor 52. As described above, after a specific time, the limit switch (54) comes in contact with the connecting part and the contact changes from "b" to "a". At this time the fan cover is wide open. When the contact of the limit switch 54 changes to "a", the ventilation fan (51) is activated. When solar light falls below the threshold, the contact of the light sensor switch (55) changes from "b" to "a" to turn itself off. Then the contact of the relay switch (53) changes from "b" to "a" to re-activate the electric motor (52). As described above, after a specific time, the contact changes from "a" to "b" because the limit switch (54) comes in contact with the connecting part. At this time the vent cover is closed. When the contact of the limit switch (54) changes to "b", electricity is cut off and the ventilation fan (51) stops. As explained above, if one wishes to stop the system, he can do so by turning off the main switch (56).

Figure 6A:
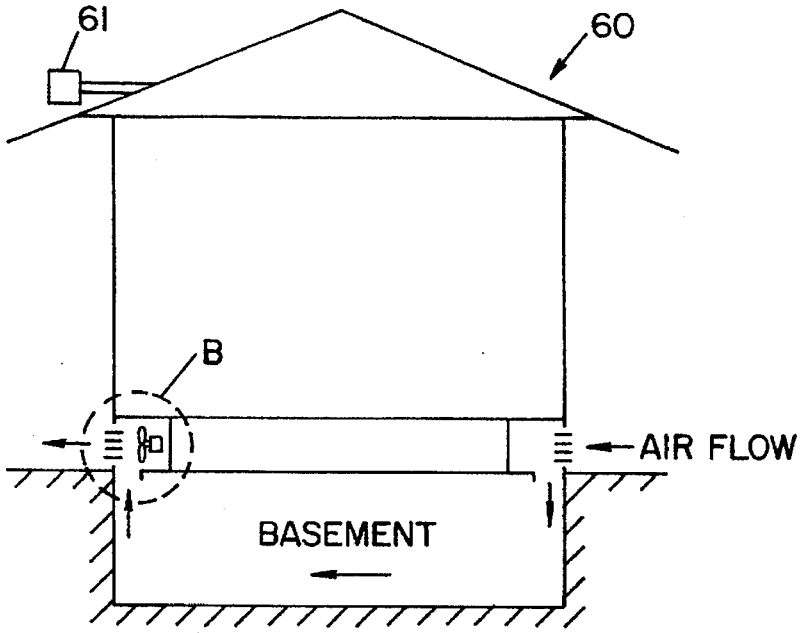
FIG. 6(A) is a sketch of the second application of the light responsive ventilation system of this invention.
Figure 6B:
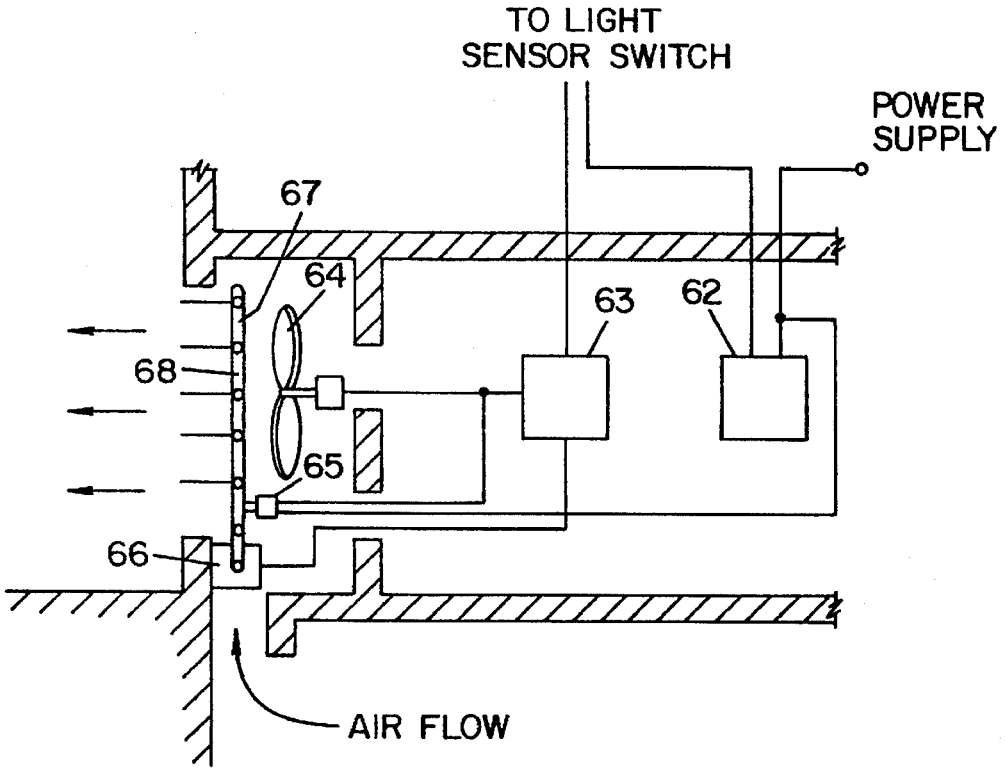
FIG. 6(B) is a magnified sectional sketch of the driving portion B inside Picture 6(A).
Figure 12:
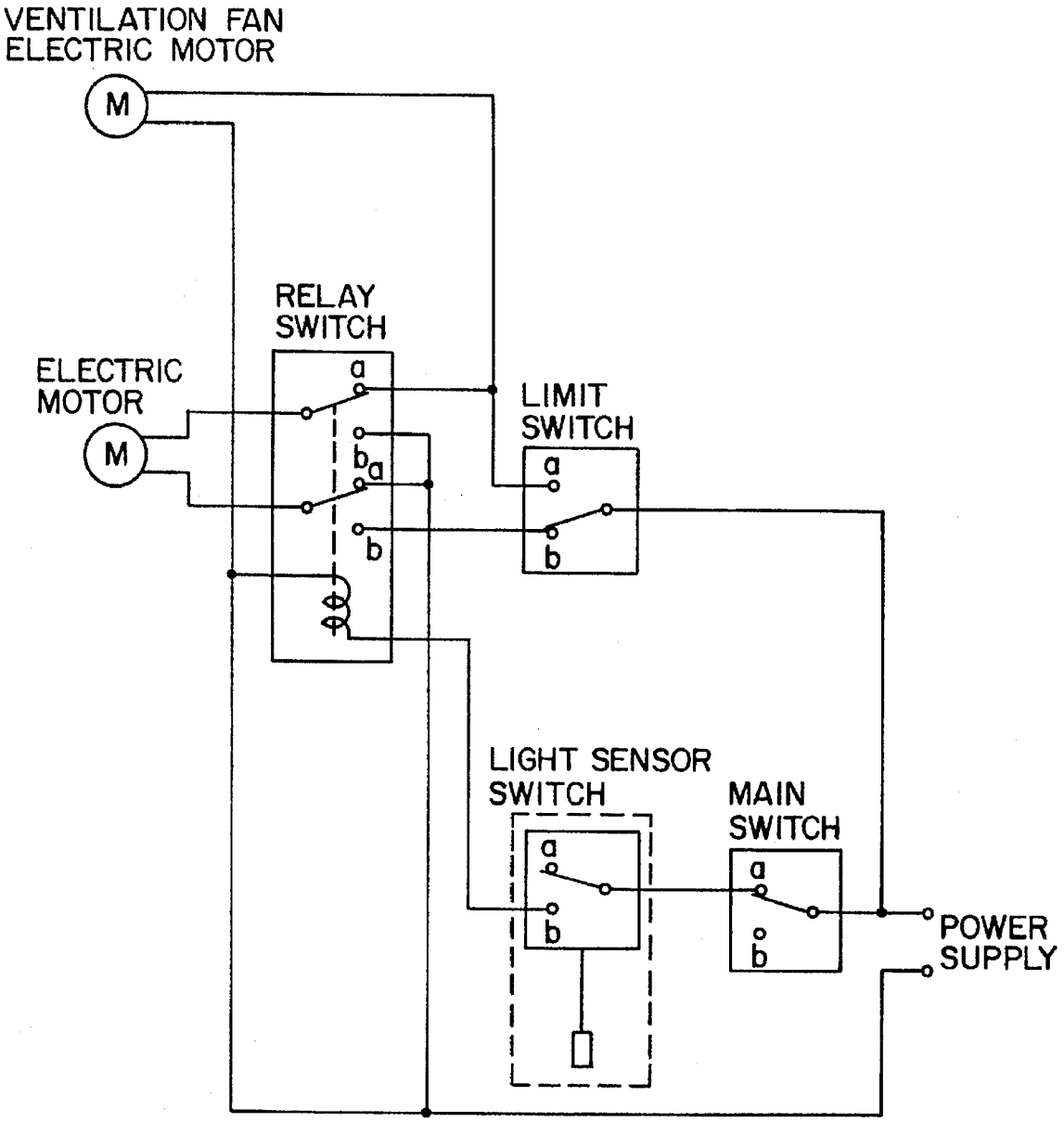
FIG. 12 is a modified direct current type circuit, replacing a relay switch with a 2-circuit 2-contact type in the basic circuitry of the second application of the light responsive driving device of this invention.
Figure 13:
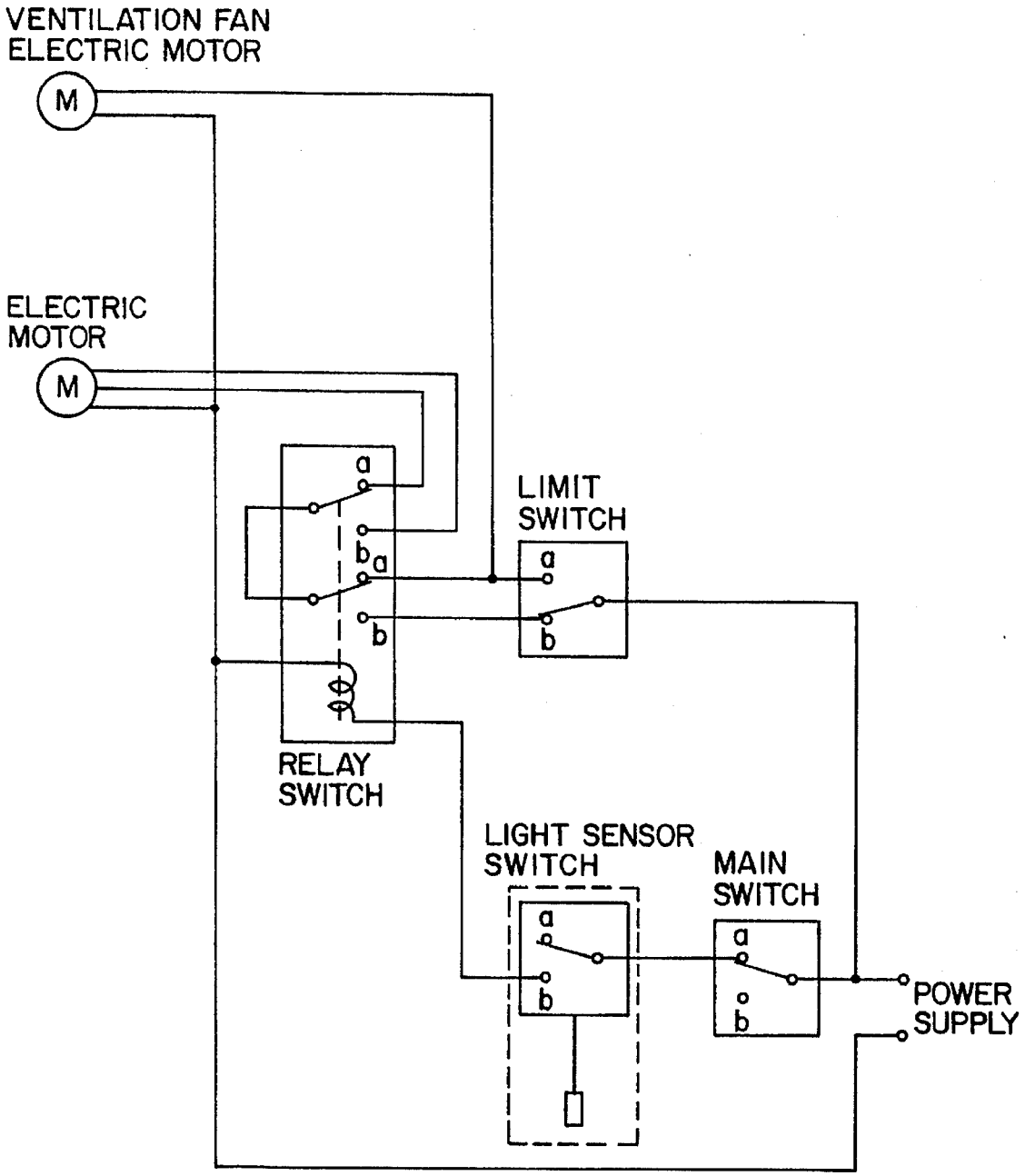
FIG. 13 is a modified alternating current type circuit, replacing a relay switch with a 2-circuit 2-contact type in the basic circuitry of the second application of the light responsive driving device by this invention.
Figure 14:
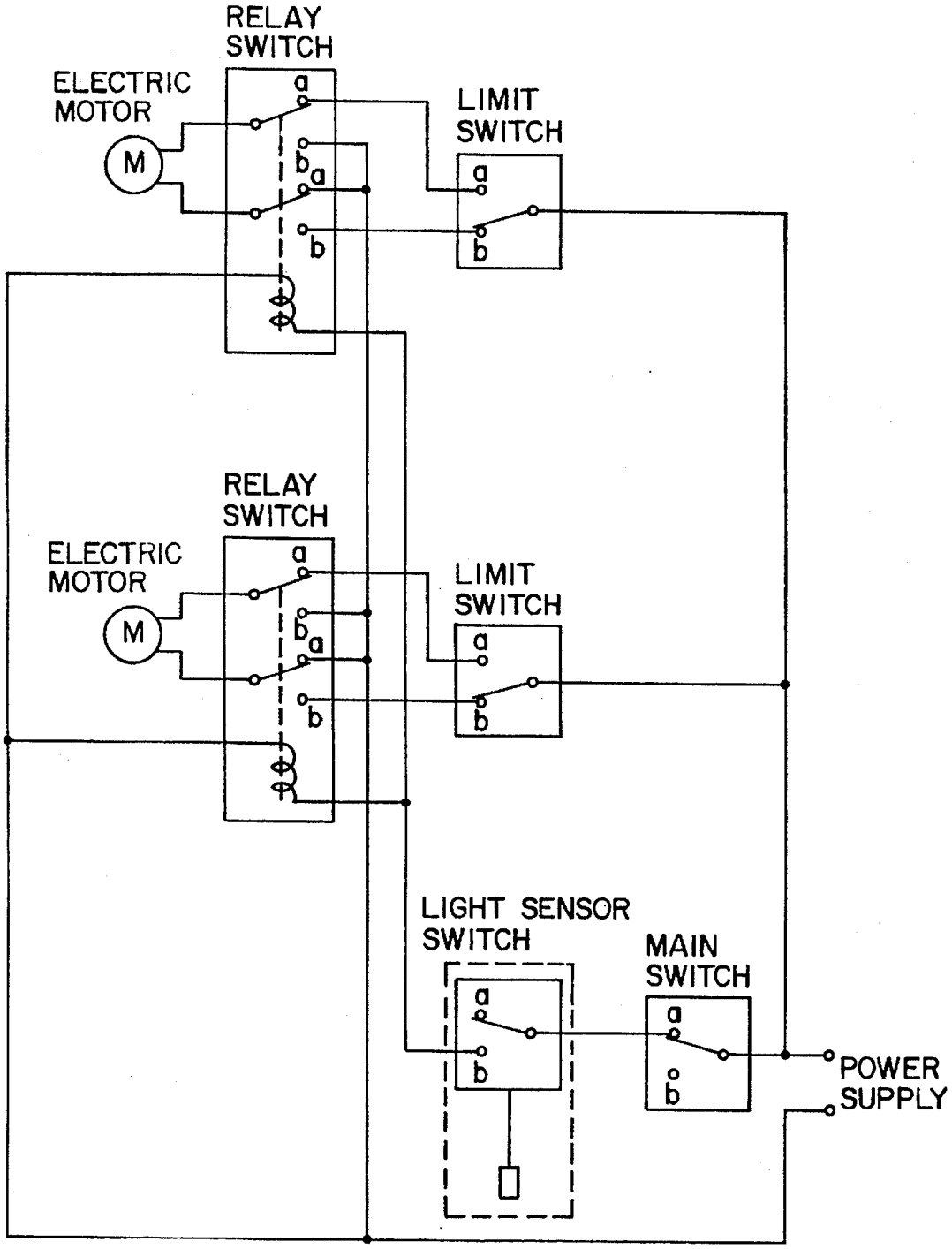
FIG. 14 is a modified direct current type circuit, replacing relay switches with a 2-circuit 2-contact type in the basic circuitry of the third application of the light responsive driving device of this invention.
Figure 15:
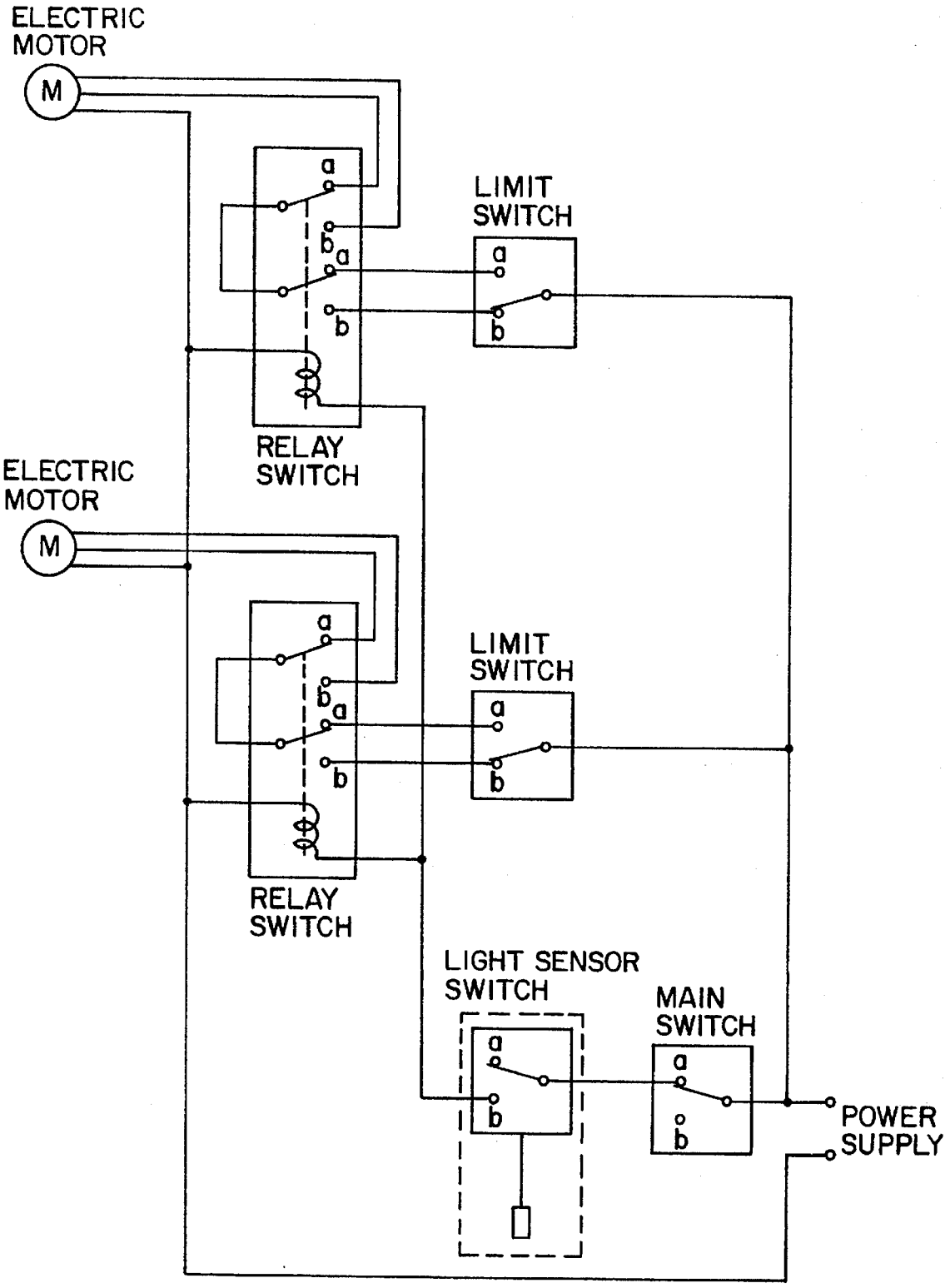
FIG. 15 is a modified alternating current type circuit, replacing relay switches with a 2-circuit 2-contact type in the basic circuitry of the third application of the light responsive driving device of this invention.

FIG. 6 represents the second example of application of the automatic ventilation system of this invention, which is the combination of the light responsive driving device comprised of the basic circuitry in FIG. 5 and the power transmission in FIG. 4(A). FIG. 6(A) shows the automatic ventilation system, generally indicated by the numeral (60), which is installed at the basement of a building for ventilation FIG. 6(B) is a magnified picture of the driving unit of circle B of FIG. 6(A). The automatic ventilation system (60) consists of the light sensor switch (61)installed on a roof, the main switch (62), the,relay switch (63), the ventilation fan (64), the limit switch (65), the electric motor (66), the power transmission (67), the vent cover (68) and the power supply. Arrows in the FIGS. 6(A) and 6(B) show air flow. The power transmission (67) is attached along the inner wall of the vent near the vent. The ventilation fan (64) is located close to them and further inward than the power transmission (67) and the vent cover (68). It should be noted that the ventilation fan (64) cannot be activated until the vent cover (68) is wide open. Since the ventilation fan (64) is not interacted with the vent cover (68), energy to be consumed by the ventilation fan until the vent cover Comes to wide open can be conserved. Furthermore, the ventilation fan (64) stays activated until the vent cover (68) comes to a close and stops. The minute the vent cover closes, the fan stops. With this, users can avoid sudden rain getting into the vent in seer. FIGS. 12 (direct current) and 13 (alternating current) represent circuit schematics using 2-circuit 2-contact type relay switches. In this case too, a two directional rotating power transmission shown in FIG. 4(B) is used, same as the desirable application of FIG. 3.

Figure 7:
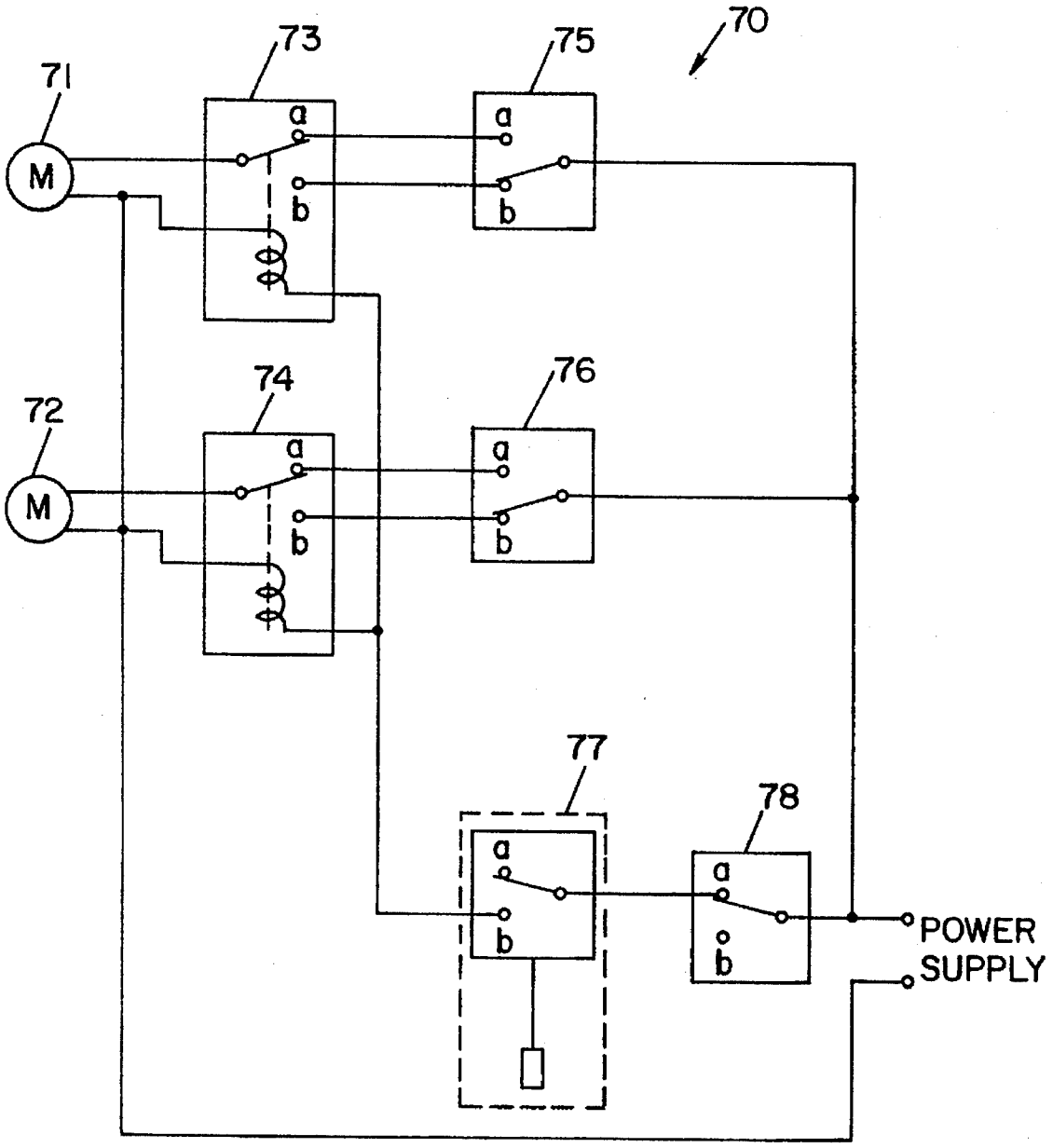
FIG. 7 is the basic circuitry of the third application of the light responsive driving device of this invention.

FIG. 7 shows the basic circuitry schematic for the third example of the light responsive driving device application of this invention. The driving device, generally indicated by numeral (70), is comprised of two identical units, which consists of the light sensor switch (77), the main switch (78), the power supply, the electric motor (71), the relay switch (73) and the limit switch (75). The units are aligned parallel to each other and the light sensor switch (77) is connected so as to control the relay switches (73 and 74) simultaneously. The limit switches (75 and 76) are independent devices to control each electric motor.

Figure 8:
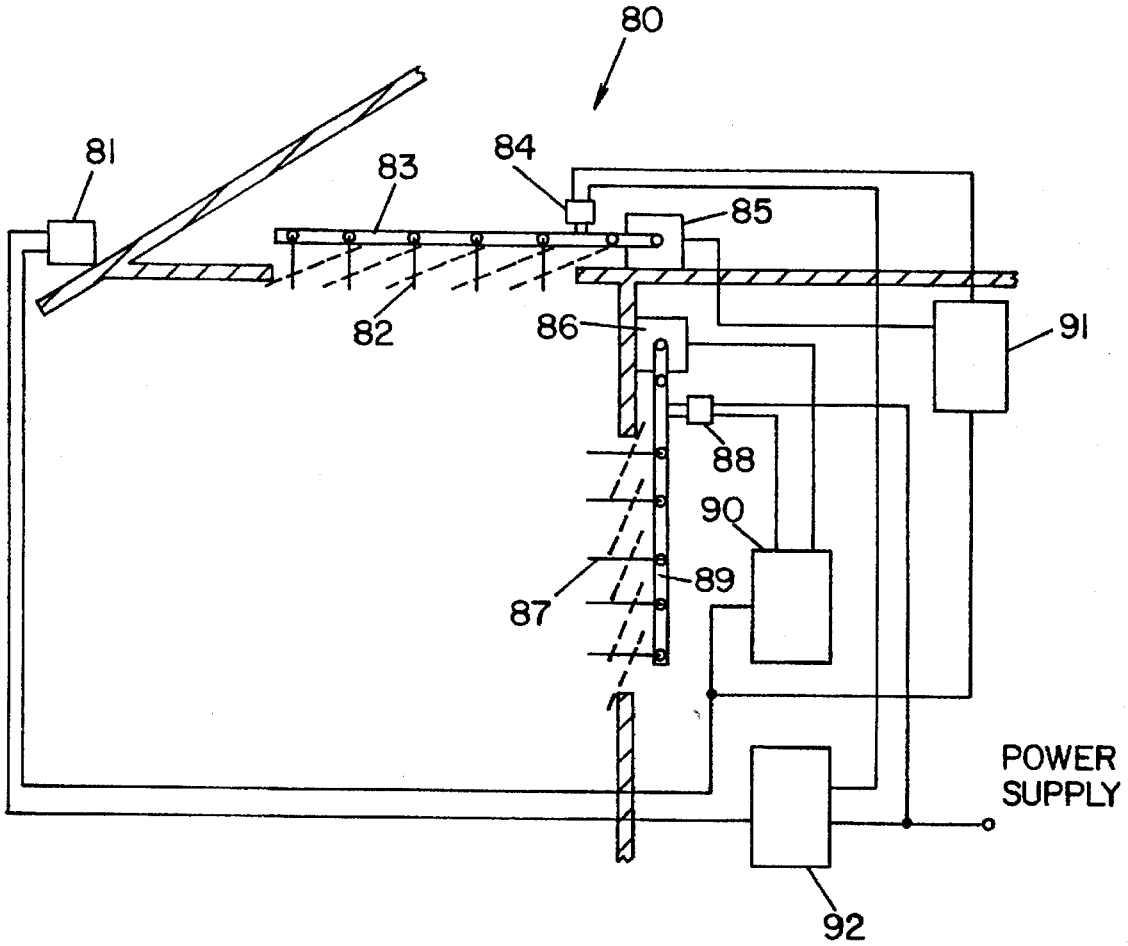
FIG. 8 is a sketch of the third application of the light responsive driving device of this invention.

FIG. 8 represents the third example of the automatic ventilation system application of this invention, which is the combination of the power transmission in FIG. 4(A) and the light responsive driving device basic circuitry in FIG. 7. FIG. 8 shows the automatic ventilation system, generally indicated by the numeral (80), installed in an attic of a building or at a window. The automatic ventilation system is comprised of the light sensor switch (81) which is installed on the roof, the main switch (92), the relay switches (90 and 91), the electric motors (85 and 86), the limit switches (84 and 88), the power transmissions (83 and 89), the vent covers (82 and 87) as well as the power supply. The power transmissions (83 and 89) are installed close to the vent along the inner wall of the vent. When solar light exceeds the threshold, the light sensor switch turns on and controls the relay switches (90 and 91) simultaneously to turn them on. Then the electric motors (85 and 86) open the vent covers (82 and 87) at the same time. In this case the shape and size of the vent covers can be different from one another, corresponding to the shapes and space of the vents. It is possible to activate the limit switches (84 and 88) independently. For example, the window vent cover (87) can be activated prior to the attic vent cover (82). This can be achieved by making the Groove of the attic's power transmission (82) longer than that of the window's power transmission (89).

FIG. 12 (direct current) and 13 (alternating current) show circuit schematics in which 2-circuit 2-contact relay switches are used. In this case, two directional rotating power transmissions shown in FIG. 4(B) is used, same as the desirable application of FIG. 3.

FIG. 9 illustrates another application example of the light responsive driving device of this invention. The circuitry of FIG.9 is the structure that uses the basic circuitry of the desirable application example shown in FIG. 2 and one additional light sensor switch that is connected in parallel. Normally the light sensor switches (A and B) are of the same specification, but depending upon outdoor climatic conditions they can be different, for example, having different thresholds.

Three of more light sensor switches can be connected in parallel. Due to the parallel connection of the light sensor switches (A and B), only one of the light sensor switches needs to detect solar light higher than the threshold in order to activate the system. Therefore the circuit is an OR circuit.

Thus far the light responsive driving device was explained by using the three application examples of the automatic ventilation system which is combined with the power transmission of this invention. Other than the above, it can be applied to automated curtains, automated blinds as well as automated awning. For these applications, besides the rectangular shaped plates, the combination of a wire rope and a bobbin can be used for the power transmission.

The automatic ventilation system of this invention provides a ventilation system totally free from manual operations. As vent covers automatically open only when it is clear during the day and close automatically against sudden bad weather or in the evening, advantages gained through this system include sufficient ventilation for a building, a factory or a warehouse, prevention of rain getting inside, and insulation improvement in winter and summer.

Since the automatic ventilation system of this invention is able to automatically maintain the vent covers opening and closing, by combining it with a ventilation fan it can be more economical and ventilation effects during the day improves further more. In addition, as the manual main switch can shut down the entire system, economy and safety can be assured at the time of a long-term shut down or maintenance.

Furthermore, by using the automatic ventilation system of this invention, ventilation of a number of places such as a building's attic, a window, and a basement can be done simultaneously. Thus ventilation of the entire building significantly improves and consequently the building can be protected from hazards such as mold and termites.

We claim:

1. A photosensitive driving device which operates automatically responding to intensities of solar light, comprising;

an electric driving means to provide mechanical power, a power supply means to supply power to said electric driving means, a relay switch to be connected to and activate said electric driving means, a limit switch to be connected between said relay switch and said power supply means, and a light sensor switch to be linked between said relay switch and said power supply means and to detect intensities of solar light, wherein when the solar light intensity exceeds a predetermined threshold, said light sensor switch turns on, whereby said relay switch automatically turns on to activate said electric driving means, and after a constant time, said limit switch turns off and said electric driving means automatically stays off.

2. A photosensitive driving device as described in claim 1, further including a manual main switch between said light sensor switch and said power supply means, wherein when said manual main switch is turned off, said electric driving means is forcibly turned off independently of solar light.

3. A photosensitive driving device as described in claim 1 wherein said electric driving means is an electric motor.

4. A photosensitive driving device as described in claim 1 wherein said power supply means supplies either direct or alternating current.

5. A photosensitive driving device as described in claim 1 wherein said predetermined threshold is desirably selected by said light sensor switch depending upon seasons and sunshine conditions.

6. A photosensitive driving device as described in claim 2 further including at least an additional light sensor switch connected parallel to said light sensor switch, whereby at least one OR circuit is formed.

7. A photosensitive driving device as described in claim 2 further including an additional electric driving means which is connected to said electric driving means at one end and connected to said limit switch at the other end, whereby the additional electric driving means is joined in parallel with said electric driving means.

8. A photosensitive driving device as described in claim 2 further including at least two units which are comprised of said electric driving means, said relay switch, and said limit switch, wherein each of said units is connected in parallel respectively, each relay switch of said units is connected to the light sensor switch at one end to allow a plurality of relay switches to be simultaneously controlled by the light sensor switch, and each limit switch of said units is connected to each relay switch respectively to control each of said electric driving means independently.

9. A photosensitive driving device as described in claims 1, 2, 3, 4, 5, 6, 7, or 8, wherein said light sensor switch, the limit switch, and the relay switch are respectively the kind of 1-circuit 2-contact type.

10. A photosensitive driving device as described in claims 2, 7, or 8, wherein said light sensor switch and said limit switch are the kind of 2-circuit 2-contact type and said relay switch is the kind of 2-circuit 2-contact type.

11. An automatic ventilation system responding to the intensity of solar light, comprising;

(a) a photosensitive driving device which operates automatically responding to intensifies of solar light, comprising;

an electric driving means to provide mechanical power, a power supply means to supply power to said electric driving means, a relay switch to be connected to and activate said electric driving means, a limit switch to be connected between said relay switch and said power supply means, and a light sensor switch to be linked between said relay switch and said power supply means and to detect intensities of solar light, (b) a power transmission member to convert rotating power of said electric driving means to reciprocating linear movement, and (c) at least one rectangular-shaped plate connected rotatably to said power transmission member at one end, wherein if the solar light intensity gets above a predetermined threshold, said light sensor switch turns on, whereby said relay switch automatically turns on to activate said electric driving means in order to open each said rectangular-shaped plate, and after a constant time, said limit switch is turned automatically by said power transmission member so that each said rectangular-shaped plate is left open, on the other hand, if the solar light intensity gets below a predetermined threshold, said light sensor switch turns off, whereby said relay switch automatically turns off to activate said electric driving means in order to close each said rectangular-shaped plate, and after a constant time, said limit switch is turned automatically by said power transmission member so that each said rectangular-shaped plate is left closed.

12. An automatic ventilation system as described in claim 11, wherein said electric driving means is an electric motor.

13. An automatic ventilation system as described in claim 11, wherein said power supply means supplies either direct or alternating current.

14. An automatic ventilation system as described in claim 11, wherein said predetermined threshold is desirably selected by said light sensor switch depending upon seasons and sunshine conditions.

15. An automatic ventilation system as described in claim 11, further including a manual main switch between said light sensor switch and said power supply means, wherein when said manual main switch is turned off, said electric driving means is forcibly turned off independently of solar light.

16. An automatic ventilation system as described in claim 15 further including at least an additional light sensor switch connected parallel to said light sensor switch, whereby at least one OR circuit is formed.

17. An automatic ventilation system as described in claim 15 further including an additional electric driving means which is connected to said electric driving means at one end and connected to said limit switch at the other end, whereby the additional electric driving means is joined in parallel with said electric driving means.

18. An automatic ventilation system as described in claim 17, wherein said additional electric driving means is a ventilation fan.

19. An automatic ventilation system as described in claim 15 further including at least two units which are comprised of said electric driving means, said relay switch, and said limit switch, wherein each of said units is connected in parallel respectively, each relay switch of said units is connected to the light sensor switch at one end to allow a plurality of relay switches to be simultaneously controlled by the light sensor switch, and each limit switch of said units is connected to each relay switch respectively to control each of said electric driving means independently.

20. An automatic ventilation system as described in claim 11, 12, 13, 14, 15, 16, 17, 18, or 19, wherein said light sensor switch, the limit switch, and the relay switch are respectively the kind of 1-circuit 2-contact type.

21. An automatic ventilation system as described in claim 11, 15, or 18, wherein said light sensor switch and said limit switch are the kind of 1-circuit 2-contact type and said relay switch is the kind of 2-circuit 2-contact type.

* * * * *

UNITED STATES PATENT AND TRADEMARK OFFICE

CERTIFICATE OF CORRECTION

PATENT NO. : 5,653,632

DATED : August 5, 1997

INVENTOR(S) : Taro Ogawa and Tomohiro Gohara

It is certified that error appears in the above-identified patent and that said Letters Patent is hereby corrected as shown below:

Column 9, line 21, "2-circuit 2-contact" should read --1-circuit 2-contact--.

Column 9, line 26, "intensifies" should read --intensities--

Signed and Sealed this

Nineteenth Day of May, 1998

*Attest:*

*Attesting Officer*

Bruce Lehman

BRUCE LEHMAN

*Commissioner of Patents and Trademarks*